United States Patent [19]

Goldstein

[11] Patent Number: 4,484,717

[45] Date of Patent: Nov. 27, 1984

[54] STRETCH-WRAP FILM DISPENSER WITH SINGLE DIGIT TENSION CONTROL

[76] Inventor: Joseph Goldstein, 1325 Southwind Cir., Westlake Village, Calif. 91361

[21] Appl. No.: 449,444

[22] Filed: Dec. 13, 1982

[51] Int. Cl.[3] ..... B65H 75/40

[52] U.S. Cl. ..... 242/96; 242/99; 188/67

[58] Field of Search ..... 242/75.4, 77.4, 96, 242/99, 156; 188/67, 77 R, 74

[56] References Cited

U.S. PATENT DOCUMENTS 2,692,093 10/1954 Tengesdal ..... 242/99 X
2,757,881 8/1956 Halsey ..... 242/99 X
3,127,125 3/1964 Jilbert ..... 242/75.4
4,179,081 12/1979 Parry ..... 242/99
4,248,392 2/1981 Parry ..... 242/99 X

*Primary Examiner*—Stuart S. Levy
*Assistant Examiner*—David Werner
*Attorney, Agent, or Firm*—Allan M. Shapiro

[57] ABSTRACT

Stretch-wrap film on a roll is utilized by manual grasp on handles mounted on each end of the roll and freely rotatable thereon. A brake ring under at least one index finger can be clamped by that finger onto the spindle running with the stretch-wrap film roll, to apply braking and consequent stretch-wrap film tension.

12 Claims, 5 Drawing Figures

FIG. 1
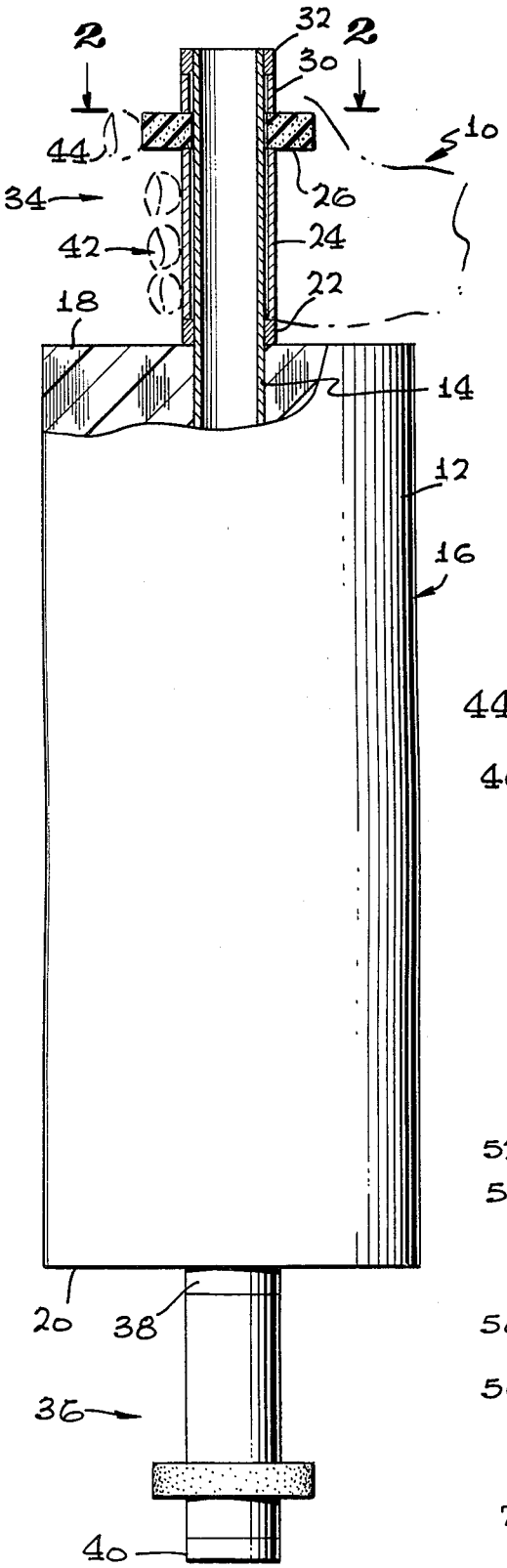
FIG. 2
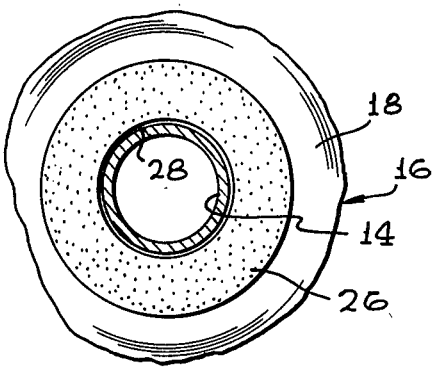
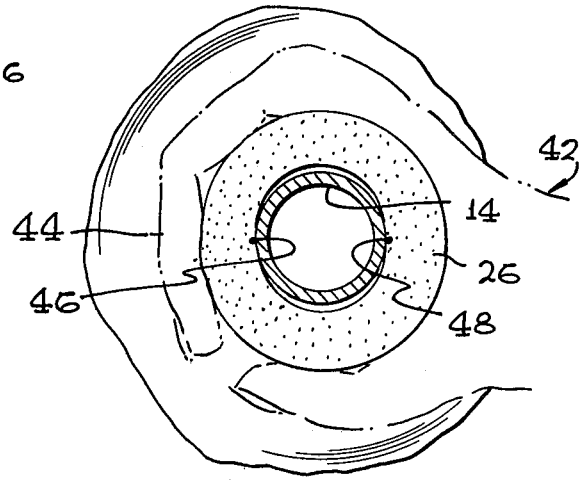
FIG. 3
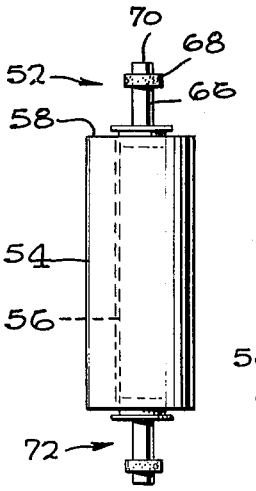
FIG. 4
FIG. 5
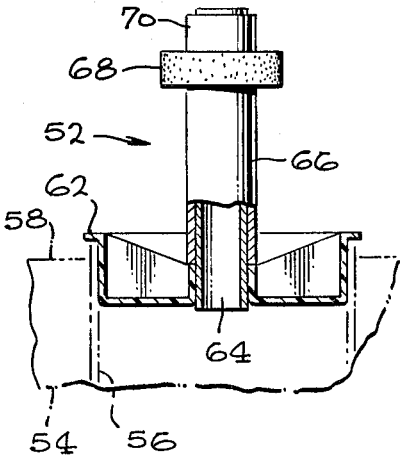

STRETCH-WRAP FILM DISPENSER WITH SINGLE DIGIT TENSION CONTROL

BACKGROUND OF THE INVENTION

This invention is directed to a stretch-wrap film dispenser which can be manually operated to wrap a load, with the tension of the film during the wrapping operation being manually controlled by engagement of a digit over a brake ring.

When a plurality of packages are grouped together, it is desirable to combine them into a load, often of the size of a pallet so that the merchandise can be transported and stored in pallet-sized units. Stretch-wrap film can be wrapped around such a group to unitize the packages into a single load. The stretch-wrap film is a polymer sheet film of resilient nature and must be applied in the tensioned, stretched form in order to securely wrap the packages into a load.

The mechanical structures which relatively rotate the load with respect to the roll have tension control means thereon so that a constant tension is applied during the entire wrapping process. When fully mechanized, such constant tension is a desirable goal. However, when the roll is manually moved around the load being stretch-wrapped, conservation of the workers' energy is achieved by permitting the stretch-wrapped film to freely unroll while the worker moves down the side of a load. Tension is only applied as he swings the stretch-wrapped film around a corner. In this way, the major part of the material can be unrolled at little or no tension, and the tension need only be applied just before the film is moved around a corner of the package. With this manner of operation, the worker does not have to move against the tension at all times, to conserve his energy.

It is, thus, desirable to have a manually operable stretch-wrap film dispenser of such construction that the tension can be quickly and easily adjusted without moving the hands to a new position, and wherein tension control from zero to a fairly high tension can be achieved by the worker with a minimum amount of movement and/or physical force.

Two patents to John C. Parry, U.S. Pat. Nos. 4,179,081 and 4,248,392 teach the control of tension of unwinding plastic stretch film by clamping of a flexible sleeve onto the core which rotates with the roll of film. This is much like clamping a glove onto a rotating shaft, and does not produce substantial braking force for the amount of grasping force applied. In those structures, the braking is produced in much the same manner as in Dean U.S. Pat. No. 3,198,175. Other interesting prior art is shown in Partridge U.S. Pat. No. 521,245 which relates to a reel particularly adapted as a kite string holder for use in flying kites. It includes structure both for winding and unwinding of the kite string, including braking tension control during unwinding.

SUMMARY OF THE INVENTION

In order to aid in the understanding of this invention, it can be stated in essentially summary form that it is directed to a stretch-wrap film dispenser which has first and second handles for positioning on opposite ends of a roll of stretch-wrap film. The handles are freely rotatable on a spindle which rotates with the film roll. A brake ring is positioned so that it will be under the index finger of the user when he places his hand on the handle. The brake ring can be squeezed by the index finger for braking contact with the spindle to control the friction and unwinding tension.

It is, thus, an object and advantage of this invention to provide a stretch-wrap film dispenser which has handles which are grasped by the operator, which handles are positioned on opposite ends of a roll of stretch-wrap film. The handles are freely rotable with respect to the film roll so that film may be unwound under nearly zero tension. A brake ring is positioned so that it is under the index finger of the operator when his hand is on one of the handles so that clamping force by the index finger on the brake ring causes frictional drag so that tension is applied to the unwinding film for proper stretch-wrapping.

It is a further object of this invention to provide a stretch-wrap film dispenser which can accurately and easily control the tension of unwinding stretch-wrap film by employment of an index finger operated brake ring, in a structure which is of such nature that it can be economically built for one time, throwaway usage, and yet provide reliable operation.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side-elevational view of the first preferred embodiment of the stretch-wrap film dispenser of this invention, with parts broken away and parts taken in substantially axial centerline section.

FIG. 2 is an enlarged sectional view as seen generally along the line 2—2 of FIG. 1.

FIG. 3 is a view similar to FIG. 2 showing the operator's grasp with his index finger around the brake ring to apply braking tension.

FIG. 4 is a side-elevational view of a second preferred embodiment of the stretch-wrap film dispenser of this invention.

FIG. 5 is an enlarged detail of one end of the stretch-wrap film dispenser of FIG. 4, with parts broken away and some parts taken generally on a section through the axial center line.

DESCRIPTION OF THE PREFERRED EMBODIMENTS

FIGS. 1, 2 and 3 show the first preferred embodiment of the stretch-wrap film dispenser of this invention, and this embodiment of the dispenser is generally indicated at 10 in FIG. 1. Stretch-wrap film 12 is wound upon a core 14 to form a roll 16. Core 14 is a cylindrical tube, usually made of cardboard so that it need not be returned for reuse. In the dispenser 10, the core 14 extends beyond the ends 18 and 20 of the roll so that the dispenser handles may be applied thereon.

Spacer 22 is a short tube positioned around core 14 just above end 18. Spacer 22 is preferably secured to the core so that it rotates therewith to prevent rubbing against the ends 18 of roll 16 to eliminate frictional heating in that portion of the stretch-wrap film. Handle 24 is also in the form of a hollow tube having sufficiently large inside diameter that it is freely rotatable on core 14. Handle 24 may also be a cardboard tube, providing it is sufficiently rigid that it does not deform and bind on core 14, when grasped in a normal manner.

Brake ring 26 is a resilient annular structure of rubberlike material having an inside bore 28 sufficiently large that, in the absence of deflection of the brake ring, the brake ring does not bind on core 14. The spacing in normal free running operation is best seen in FIG. 2. Outwardly on core 14 from brake ring 26, upwardly in FIG. 1, is spacer 30 which is freely running on the core and is preferably the same size and material as handle 24. Outward from spacer 30 is stop 32 which closely fits the core 14 and is secured thereto. Both the spacer 22 and stop 32 can be made of the same material, such as cardboard, and both are secured to the core as by gluing or stapling. The total spacing between spacer 22 and stop 33 is greater than the total length of handle 24, brake ring 26 and spacer 30 so that there is endwise freedom of the rotating parts on the core. Spacer 30 is employed adjacent brake ring 26 to aid in rotative freedom, but in a simpler structure the stop 32 could extend all the way down to brake ring 26.

The handle 24, brake ring 26 and optional spacer 30, when used, comprise handle assembly 34. On the lower end of dispenser 10, there is a handle assembly 36 which is positioned between spacer 38 and stop 40 which correspond to the similar parts at the top of FIG. 1. The spacer and stop are secured to the core 14 at the lower end thereof. As illustrated, the handle assembly 36 is identical to the handle assembly 34 and operates in the same way. The dispenser 10 is used by grasping the handle assemblies with the index fingers of the two hands on the brake rings. The right hand 42 of the operator is shown at the top of FIG. 1, with his index finger 44 grasping brake ring 26. This is also seen in FIG. 3. The operator grasps the handle assembly 36 in his left hand with his left index finger around the lower brake ring. As long as no substantial squeezing force is applied to the brake rings, the roll 16 runs substantially free on the core. When tension is desired, the operator squeezes one or both of the brake rings so that the squeezed brake ring contacts the core to apply unwinding friction. Contact points 46 and 48 are shown in FIG. 3. When squeezed in this way, rotative friction is applied to core 14, and this results in tension in the unwinding stretch-wrap film. The tension can be controlled by the amount of squeezing of the brake rings. Force is only required on the index fingers, and the remaining portion of the hand can be employed to control the stretch-wrap film dispenser without the need for grasp by the remaining fingers beyond that needed for mere holding and positioning of the dispenser. With the brake ring 26 made of suitably resilient, high friction material, proper tensioning of the stretch-wrap film can be achieved without excessive deflection forces required of the index finger. Tension can be varied by the amount of grasping force applied by the index finger so that variations in tension can be instantly achieved as the operator wraps stretch-wrap around a load.

Dispenser 10 is structured in a manner that it employs as a bearing and friction surface the portion of the core 14 which extends outward from roll 16. In those cases where the core does not extend out, a similar design can be employed for insertion into the ends of shorter cores. Stretch-wrap film dispenser 52 is the second preferred embodiment of the dispenser of this invention. It is associated with stretch-wrap film roll 54 which has a core 56. The core does not extend substantially past end 58 of roll 54. For this reason, dispenser 52 is designed to insert into the end of the core. The cup shown in FIG. 5 is dimensioned to fit into core 56 and has a flange 62 which engages on the end of the core to limit the insertion and square the cup with respect to the core. Spindle 64 is fixed in cup 60 and extends outward from end 58, upward in FIGS. 4 and 5. Spindle 64 is a cylindrical tube and corresponds to core 14, which also acts as a spindle in dispenser 10. Handle 66 is a cylindrical tube which is freely mounted on the spindle. Handle 66 is sufficiently rigid that, in normal grasp, it is not squeezed into contact with the spindle. Brake ring 68 is of the same construction as brake ring 26. Brake ring 68 is mounted on the spindle above handle 66. Stop 70 is fixed to spindle 64 above brake ring 68. A dispenser handle assembly 72, identical to the dispenser handle assembly 52, is inserted into the lower end of core 56, as shown in FIG. 4. The dispenser handle assemblies are structured so that the handle 66 can be grasped with three fingers to guide and control the stretch film roll 54 while the brake ring 68 is grasped with the index finger. In the undeflected position, brake ring 68 rotates freely on spindle 64 but, when the index finger grasps and squeezes the brake ring, it frictionally engages with the spindle, in a similar way to that shown in FIG. 3. Thus, rotative braking is achieved by deflection of the brake ring with the index finger. Accurate tension control is immediately achieved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A stretch-wrap film dispenser comprising:

a central spindle for rotating with a roll of stretch-wrap film;

a substantially rigid tubular handle mounted on the exterior of said spindle and spaced therefrom so that said tubular handle is freely rotable on said spindle, said substantially rigid tubular handle being sufficiently rigid that normal manual grasp of said handle does not cause binding of said handle on said spindle; and an annular brake ring of resilient material engaged around and spaced from said spindle in its undeflected position and positioned on said spindle axially adjacent said handle, said handle and said brake ring being so dimensioned and said brake ring being formed of sufficiently flexible material that one finger of the user's hand can engage around said brake ring to deflect it into braking engagement with said spindle while some of the user's other fingers engage around said handle adjacent said brake ring so that the user can support and guide a roll of stretch-wrap film and by grasping compression on said brake ring can control unwinding tension.

2. The stretch-wrap film dispenser of claim 1 wherein said spindle is a core upon which stretch-wrap film can be wound and from which it can be unwound.

3. The stretch-wrap film dispenser of claim 2 wherein said spindle and said handle are made of cardboard so that said stretch-wrap film dispenser can be used for wrapping with a single roll of stretch-wrap film.

4. The stretch-wrap film dispenser of claim 3 wherein a spacer is attached to said core between said handle and the stretch-wrap film wound on said core to space said handle from a stretch-wrap film wound on said core.

5. The stretch-wrap film dispenser of claim 4 wherein a stop is secured to said core on the end of said core away from said brake ring to maintain said brake ring on said core.

6. The stretch-wrap film dispenser of claim 2 wherein there is a handle freely rotatably mounted on said core and a brake ring rotatably mounted on said core outboard of said handle on each end of said core.

7. The stretch-wrap film dispenser of claim 6 wherein a spacer is secured to said core between each said handle and the stretch-wrap film wound on said core to space said handles from a stretch-wrap film wound on said core.

8. The stretch-wrap film dispenser of claim 1 wherein said spindle is mounted on a plug which engages into the end of a core of a roll of stretch-wrap film.

9. The stretch-wrap film dispenser of claim 8 wherein said spindle and said handle are made of cardboard so that said stretch-wrap film dispenser can be used to wrapping with a single roll of stretch-wrap film.

10. A stretch-wrap film dispenser comprising:

a core upon which stretch-wrap film can be wound;

a spindle positioned substantially coaxially with said core at end thereof;

a substantially rigid tubular handle rotatably mounted on said spindle adjacent each end thereof, each said handle being sufficiently rigid so that in normal grasp, each said handle does not frictionally engage with said spindle;

an annular brake ring positioned on each end of said spindle adjacent said handles, each said brake ring being made of resilient material, each said brake ring having a bore therethrough sufficiently large that said brake ring does not substantially frictionally engage with said spindle in its undeflected position, each said brake ring being sufficiently resilient so that it can be deflected with the grasp of the dispenser user's finger to engage on said spindle to apply rotative braking drag to said spindle; and first and second stops positioned on said spindle respectively outboard of said brake rings to hold said brake rings and said handles onto said spindles so that said handles can each be grasped with fingers and said brake rings can each be grasped with a finger for control of stretch-wrap film wrapped on said core and tensioning of the stretch-wrap film by squeezing of said brake rings.

11. The stretch-wrap film dispenser of claim 10 wherein said spindles comprise portions of said core extending outwardly beyond stretch-wrap film wound on said core.

12. The stretch-wrap film dispenser of claim 11 wherein there is a spacer positioned on said core inboard of each of said handles to space said handles away from stretch-wrap film wound on said core between said spacers.

* * * * *